United States Patent [19]

Johnson

[11] Patent Number: 4,653,420

[45] Date of Patent: Mar. 31, 1987

[54] PROTECTIVE COVER FOR BOAT HOIST BUMPERS

[76] Inventor: Thomas H. Johnson, 520 Central Ave. - Box 101, Northwood, Iowa 50459

[21] Appl. No.: 811,771

[22] Filed: Dec. 20, 1985

[51] Int. Cl.[4] ..... B63B 59/02

[52] U.S. Cl. ..... 114/219; 150/52 R; 114/44; 405/3; 405/216

[58] Field of Search ..... 114/219, 344, 44, 45, 114/220; 280/414.1; 405/3, 213, 215, 216; 150/52 R, 52 E

[56] References Cited

U.S. PATENT DOCUMENTS

| | | | |
|---|---|---|---|
| 2,753,829 | 7/1956 | Agra | 114/219 |
| 3,185,197 | 5/1965 | Spiro et al. | 150/52 R |
| 3,828,715 | 8/1974 | Matsushita | 114/219 |
| 4,010,962 | 3/1977 | Groblebe | 280/414.1 |
| 4,074,649 | 2/1978 | Stranahan | 114/219 |

FOREIGN PATENT DOCUMENTS

| | | | |
|---|---|---|---|
| 2091842 | 8/1982 | United Kingdom | 114/219 |

*Primary Examiner*—Sherman D. Basinger

*Attorney, Agent, or Firm*—Peterson, Wicks, Nemer & Kamrath

[57] ABSTRACT

A protective cover for fragile boat bumpers includes two sheets of relatively thin rubber having a sheet of criss-crossing fibers therebetween, the two rubber sheets being fused to each other. The cover is initially formed from a blank of sheet stock comprised of two flat panels and a flange or wing extending from one of said flat panels so that when said flange or wing is overlapped with a marginal portion of the other of such panels and bonded thereto, a relatively flat tubular body is formed with a passage extending therethrough. The body has a pair of flaps hingedly connected to each end thereof so that the protective cover can be pulled downwardly over a boat bumper so as to protect the foamed sleeve of which the bumper is comprised from impact forces that would break and otherwise damage the relatively fragile foamed plastic, usually polystyrene.

8 Claims, 9 Drawing Figures

PROTECTIVE COVER FOR BOAT HOIST BUMPERS

FIELD OF THE INVENTION

This invention relates generally to boat hoists, and pertains more particularly to covers for protecting the foamed plastic bumpers used in conjunction with most boat hoists.

SUMMARY OF THE INVENTION

Boat hoists for lifting a boat out of the water have become quite common. In order to protect the sides of the boat, foamed polystyrene bumpers are employed. While these bumpers adequately protect the boat from damage, the relatively fragile foamed plastic is vulnerable to damage due to the impacting of the boat thereagainst. The damage can result from the boat operator not properly steering his boat between the bumpers and also from rough weather in which the boat is repeatedly forced against the bumpers by wave and wind action. Although the life of a given polystyrene bumper, frequently referred to as a "log", depends upon the severity of the conditions to which the boat is subjected, any need for replacing the foamed polystyrene, even if infrequent, proves to be an unnecessary expense. Where the conditions are relatively severe, then the replacing of the polystyrene bumpers can be quite costly. It should be recognized that there are usually two or four such bumpers associated with each boat hoist.

Hence, a very real need has developed for adequately protecting the rather fragile polystyrene logs constituting the bumpers associated with a boat hoist. Therefore, a general object of my invention is to provide a cover that can be slipped over the polystyrene sleeve or log, thereby minimizing, or even obviating, damage due to impact forces resulting from the bumping of the boat thereagainst or from floating debris that might strike the bumpers while the lift is lowered, such as when the boat is in use away from the boat hoist.

A more specific object of my invention is to provide a protective cover for boat hoist bumpers that will be inexpensive, actually paying for itself in a relatively short period of time where relatively severe damage would otherwise occur.

Another object is to provide a bumper cover that will be rugged and long lasting, for all intents and purposes never requiring replacement.

Yet another object of the invention is to provide a bumper cover of the above character that can be easily installed on a given bumper and when circumstances so dictate just as readily removed.

The invention has for another object the providing of a bumper cover that will be flexible and conformable to various sizes of bumpers and also with respect to the particular curvature thereof. In this regard, an aim of the invention is to provide a cover that will distribute impact forces to such an extent that the polystyrene sleeve therewithin is virtually immune to damage or breakage.

Also, the invention has for an object the provision of a cover for protecting boat hoist bumpers that will be aesthetically pleasing, actually more so than the foamed plastic sleeve that it encircles.

Still another object is to provide a cover that will be weatherproof in that it is impervious to moisture and highly resistant to ultraviolet radiation. A cover in accordance with my invention also resists rotting, swelling, oxidation, mildew and mold.

Still another object is to provide a protective cover for the bumpers of boat hoists that can be shipped in a flat and compact condition, and later stored in such a condition in between boating seasons. Also, the invention has for an aim the leaving of my cover on the bumper when the boat hoist is being dismantled, such as is usually done in northern climates where ice formations would be apt to damage the boat hoist.

Briefly, my invention envisages a protective cover for relatively fragile foamed polystyrene bumpers frequently used in association with a variety of boat hoists. In this regard, the foamed polystyrene sleeves, this being a common material employed in the fabrication of the bumper, is vulnerable to impact forces which cause breakage of the foamed material. My protective cover involves the utilization of elastomeric sheet stock composed of two rubber laminations or layers that are bonded together with a reinforcing layer of meshed polyester therebetween. The protective cover includes a tubular body that is deformable from a generally flat condition into a generally cylindrical condition so that it can be slipped over the upper end of the boat hoist bumper, then pulled downwardly to whatever extent is needed in order to adequately protect the particular bumper that it encircles. A pair of flaps are provided at both ends of the tubular body so as to facilitate the pulling on of the cover over the polystyrene bumper. The protective covering can be easily installed and equally readily removed. Yet, the resiliency of the laminated cover is such that impact forces are adequately distributed so as to preserve the foamed material of which the bumper is made.

DESCRIPTION OF THE PREFERRED EMBODIMENT

Figure 1:
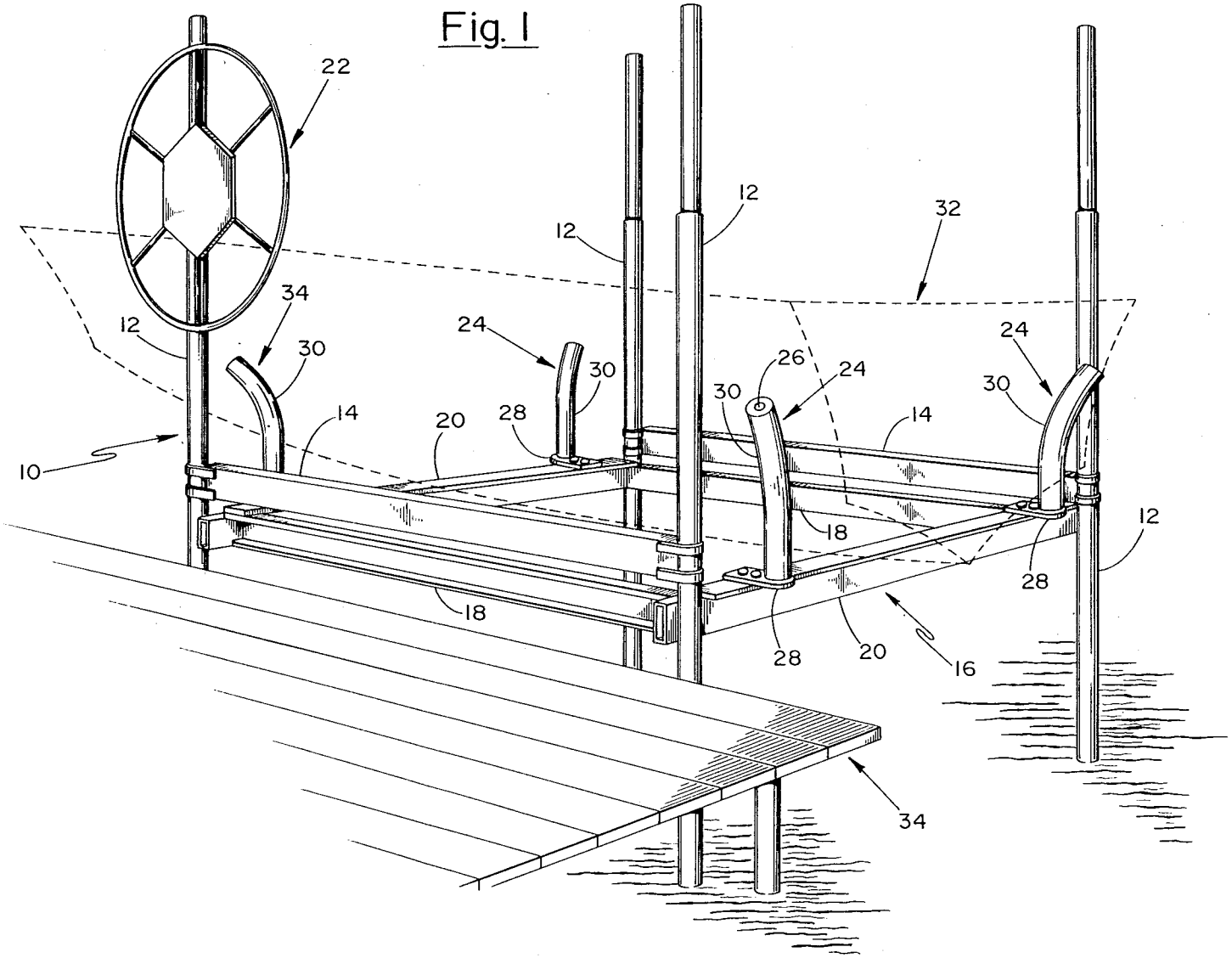
FIG. 1 is a perspective view of a conventional boat lift equipped with four relatively fragile bumpers, a portion of a typical dock also appearing in this view.

Referring first to FIG. 1, a conventional boat hoist has been denoted generally by the reference numeral 10. The boat hoist 10 includes four vertical posts 12 having supporting pads at their lower ends, the pads being concealed by the fact that they are submerged in the water. A beam 14 extends from one post 12 to another post 12 at one side of the boat hoist 10, and a second beam 14 does likewise at the other side. The boat hoist 10 additionally includes a lifter unit 16 comprised of side beams 18 and a pair of transverse beams 20. By means of a winch mechanism 22, the lift 16 can be raised and lowered through the agency of pulleys and cables (not shown).

Of importance in appreciating the benefits to be derived from a practicing of my invention, attention is now directed to four boat bumpers indicated generally by the reference numeral 24. These bumpers include in each instance a curved rod 26 having its lower end welded to a horizontal bracket 28, there being two brackets 28 extending forwardly from one of the transverse beams 20 and rearwardly from the other transverse beam 20. The rods 26 in practice are usually spring loaded, but have been mentioned as being welded to the brackets 28, largely for simplicity of description. The boat bumper 24 in each situation additionally includes a foamed plastic sleeve 30, frequently of rather fragile polystyrene. These sleeves 30 are frequently called logs.

Inasmuch as the bumpers 24 are intended to guide a boat into place on the lift 16, and thereafter protect the sides of the boat, it will be well to show a typical boat 32. The boat 32 appears only in phantom outline in order not to conceal any of the bumpers 24. For the sake of completion, a portion of a typical access dock has been shown, the portion having been labeled with the reference numeral 34.

Figure 2:
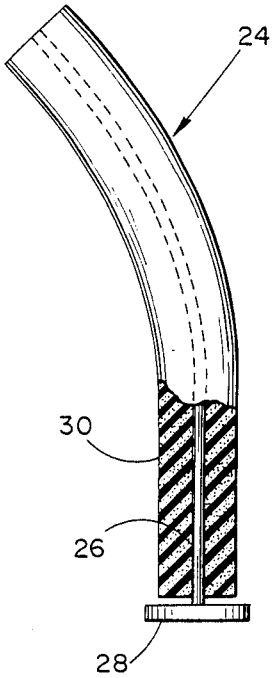
FIG. 2 is an elevational view of one of the four bumpers of FIG. 1.
Figure 3:
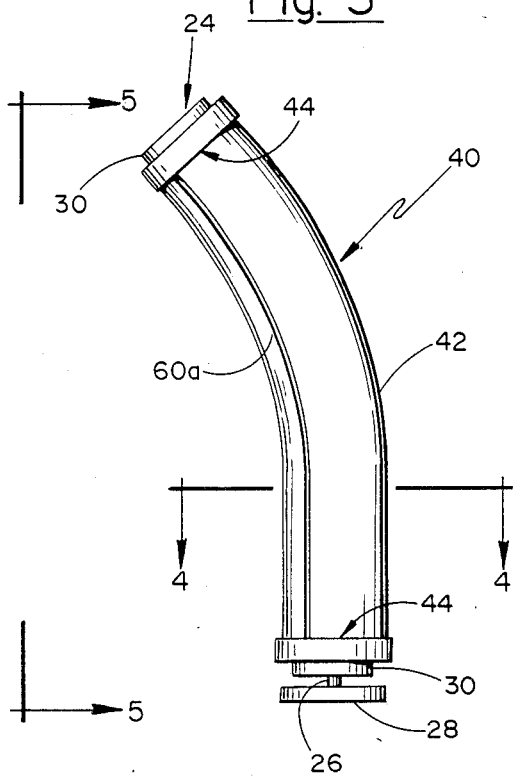
FIG. 3 is a view similar to FIG. 2 but showing one of my protective covers in place over the bumper of FIG. 2.
Figure 4:
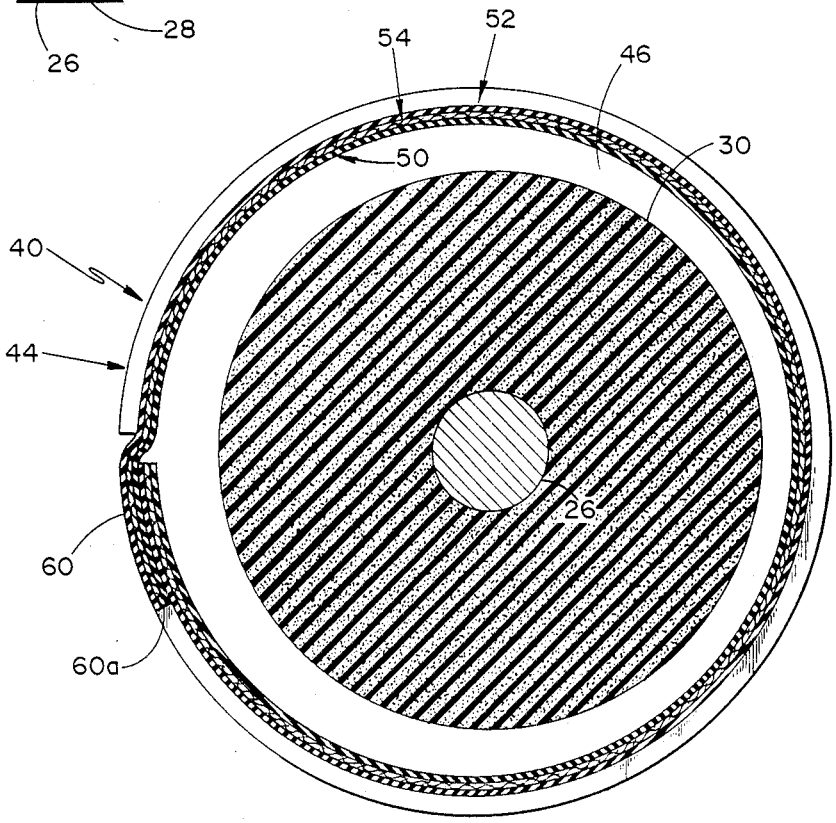
FIG. 4 is an enlarged sectional view taken in the direction of line 4—4 of FIG. 3 for the purpose of depicting my cover in its encircling relationship with respect to the bumper being protected.
Figure 5:
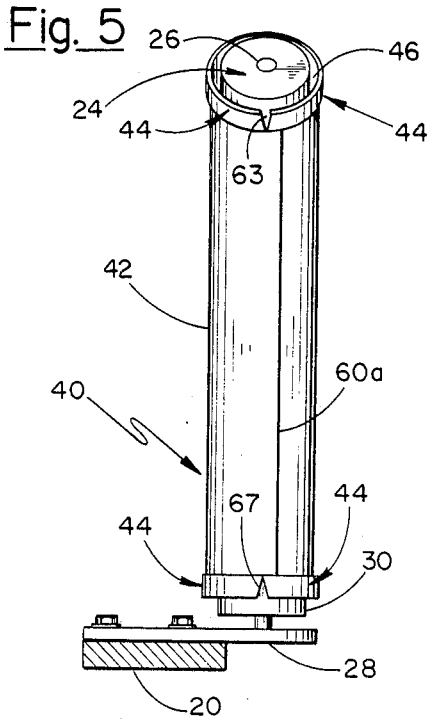
FIG. 5 is an elevational view taken in the direction of line 5—5 of FIG. 3.
Figure 6:
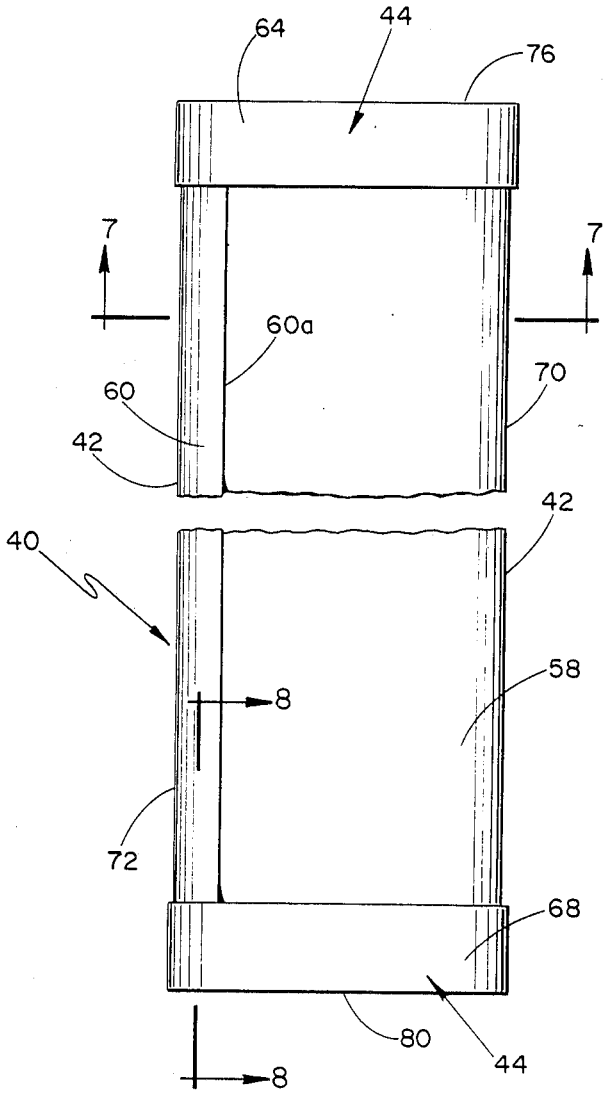
FIG. 6 is an enlarged plan view of a protective cover embodying my invention, the view depicting the cover in a flat condition.

It should be explained that the four boat bumpers 24 appearing in FIG. 1 do not as yet have my protective cover applied thereto. Even though there will be four covers utilized, inasmuch as there are four bumpers, only one cover need be described in conjunction with a single bumper. A single bumper appears in FIG. 2, whereas the single bumper of FIG. 2 has one of my protective covers placed thereover in FIG. 3. My protective cover has been indicated in its entirety by the reference numeral 40. The cover 40 includes a tubular body 42 and a pair of flaps 44 at each end of the body 42. There is a passage 46 extending completely through the tubular body 42.

At this stage, it will be pointed out that the protective cover 40 is fabricated from laminated sheet stock. In this regard, a blank 48 of such stock appears in FIG. 9. The blank 48 is comprised of a first elastomeric sheet 50 and a second elastomeric sheet 52, these sheets preferably being of rubber and constituting plies or layers. Sandwiched in between the sheets 50 and 52 is a reinforcing sheet 54 consisting of criss-crossing reinforcing fibers, such as polyester filaments.

Describing the blank 48 in greater detail, it will be discerned that it includes two rectangular panels 56 and 58, these panels actually including portions of the sheets 50, 52 and 54 therein. There is a flange or wing labeled 60 that extends to the left from the panel 58, the flange or wing 60 providing a free edge labeled 60*a*. Additionally, the blank 48 is provided with four tabs 62, 64, 66 and 68. Here again, the flange or wing 60, as well as the tabs 62–68 are laminated, being composed of portions of the previously mentioned sheets 50, 52 and 54. The two tabs 62, 64 have a slit 63 therebetween, whereas the tabs 66, 68 have a similar slit 67 therebetween.

In order to provide a facile understanding of the manner in which my protective cover 40 is fabricated from the blank 48, it will be well to refer to a central fold line 70 between the previously mentioned panels 56 and 58. Another fold line 72 appears between the panel 58 and the flange or wing 60. Each of the tabs 62–68 has a fold line, the fold line for the tab 62 being labeled 74, the fold line for the tab 64 by the numeral 76, the fold line for the tab 66 by the numeral 78, and the fold line for the tab 68 by the numeral 80. It should be explained that the alluded to fold lines 70–80 are not weakened fold lines or otherwise delineated; it is just that in manufacturing my cover 40, the blank 48 is folded along the lines that have just been referred to. It is believed helpful to identify the fold lines in the views involving the completed protective cover 40.

It will be understood that the sheets 50 and 52 are bonded together, the open mesh construction of the sheet 54 enabling this to be done. The thickness of the sheets 50 and 52 is only on the order of from 0.020 to 0.025 inch. The diameter of the fibers constituting the sheet 54 is susceptible to rather wide variation depending upon the particular material utilized. It is important that the fibers be quite flexible because they are to assist in absorbing impact forces. It is also important that they be sufficiently flexible so as to be reversely folded when the blank 48 is folded, as will presently be dealt with.

Figure 9:
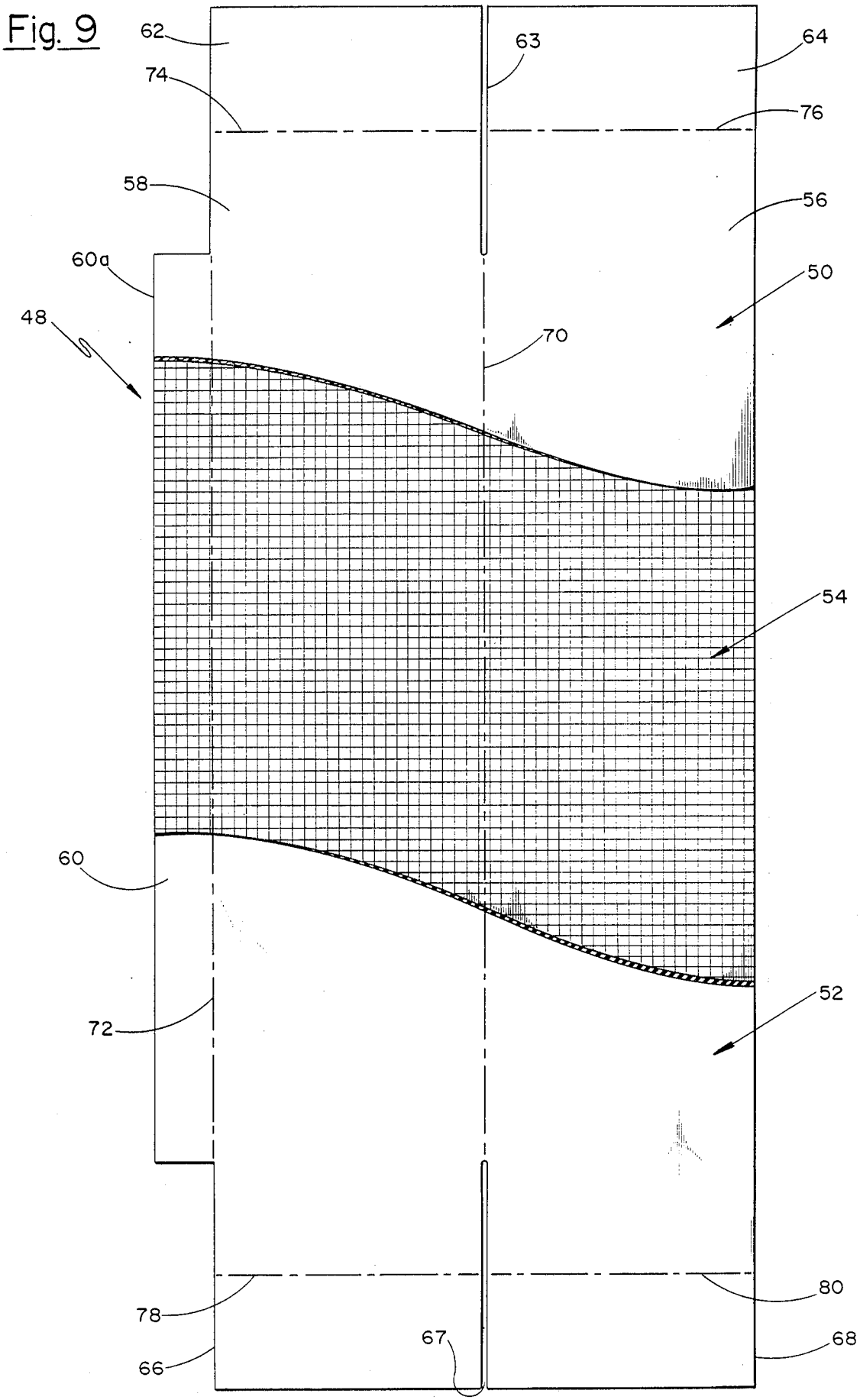
FIG. 9 is a greatly enlarged plan view of the blank from which my protective cover is fabricated.

Assuming that the blank 48 has been cut to the shape appearing in FIG. 9, then the tabs 62, 64, 66 and 68 are each folded about their respective fold lines 74, 76, 78 and 80. When so folded upon themselves, then the confronting surface portions are fused together. In this way, the flaps 44 result from the folding and bonding of the respective tabs 62–68. All that need be understood is that there are a total of four flaps 44, two being at the upper end of the cover 40 and two at the lower end.

Figure 8:
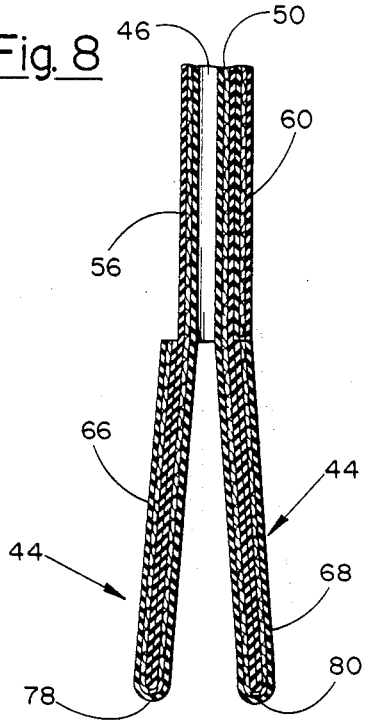
FIG. 8 is a sectional detail taken in the direction of line 8—8 of FIG. 6.

The tubular body 42 is comprised of the panels 56 and 58, as well as the flange or wing 60. To form the tubular body 42, the panel 56 is folded about the fold line 70 so that the two panels confront each other. It is then that the flange or wing 60 is folded about its fold line 72 and bonded to the marginal portion of the panel 56. The length of the flange or wing 60 is cut so that when it is folded about its fold line 72, it fits between what originally was the free edge of the tabs 62 and 66. This condition is shown at the right in FIG. 8. In other words, the flange or wing 60 presents a flush relation with the attached end of the two tabs 62 and 66.

Figure 7:
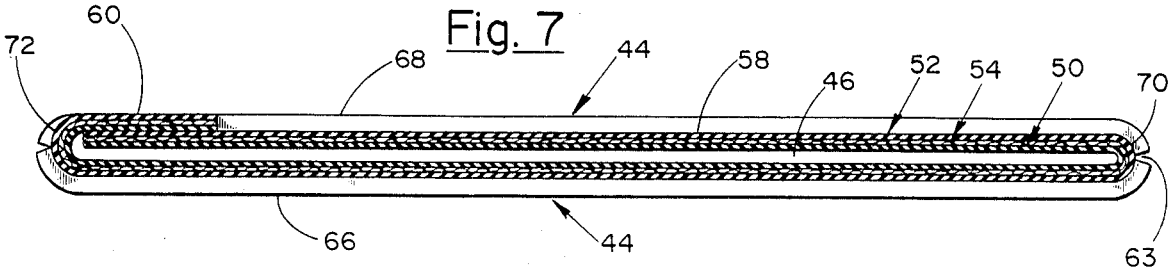
FIG. 7 is a sectional view taken in the direction of line 7—7 of FIG. 6.

FIG. 7 is believed to depict adequately how the flange or wing 60 overlaps the marginal portion of the originally appearing panel 56. Once again, a suitable bonding technique is utilized to retain the flange or wing 60 in its overlying relationship.

It will be appreciated that by using relatively thin sheets 50 and 52, the combined thickness of these sheets, when the individual sheets have a thickness of between 0.020 and 0.025 inch of only 0.040 to 0.050 inch. Of course, where the flange or wing 60 overlies the initial panel 56, then the thickness is double, as can be understood from FIG. 7. Likewise, the flaps 44, owing to their being reversely folded, have twice the thickness. It is highly desirable that the flaps 44 be quite thick, for they assist in pulling the cover 40 over a given bumper 24. On the other hand, it is desirable that the tubular body 42 be relatively thin in order that it will be quite flexible and conformable to the configuration of the particular bumper 24 with which it is to be associated.

The installing of my protective cover 40 is extremely simple and straightforward. All that the user need do is grasp two of the flaps 44 at either end of the tubular body 42. With the flaps 44 spread somewhat apart, the user is afforded the ease of simply pulling the cover 40 downwardly over a particular bumper 24. The flexibility of the body 42 enables the passage 46 to assume a cross section corresponding generally to the cross section of the bumper 24. The passage 46 is made sufficiently large when fabricating the cover 40 so as to accommodate therein bumpers 24 that may vary in cross section.

In practice, it has been found that the length of the body 42 can be approximately 24 inches, whereas the flaps 44 can have a length of approximately two inches. It will be appreciated that the user, where the bumper 24 may be quite long, can adjust the cover 40 so that it encircles the length of the bumper 24 that is most prone to damage, either from the boat 32 when entering or leaving the boat hoist or from any debris that might strike the bumpers 24 when the lift 16 is left submerged for the reaccommodation of the boat when it returns from one of its trips.

What should be recognized is that the protective cover 40, owing to its construction, is capable of rapid elastic recovery whenever it is struck by an object. The cover 40 is capable of transmitting or distributing any impact forces that might otherwise be applied to a restricted area of a given bumper 24, the cover 40 instead spreading the force over a larger area such that the bumper 24 is not damaged. It must be borne in mind that the sleeves 30, particularly when of foamed polystyrene, are extremely vulnerable to breakage. Not only is the breakage of these sleeves 30 costly as far as replacement is concerned, but any breakage or several breakages render the bumpers 24 rather unsightly. On the other hand, my protective cover 40 assures that the sleeves 30 will not be damaged and at the same time provides a continued attractive appearance.

Inasmuch as the usual boat hoist 10 makes use of two or four bumpers 24, it is planned that my protective bumper be sold in sets of two, one for each bumper 24. By reason of the flexibility thereof, coupled with the manner in which the cover 40 is fabricated, the covers 40 can be sold and distributed in a flat condition, this degree of compactness being very advantageous as far as minimizing the amount of space to be taken up, both during the shipping process and also at the point of sale. Still further, if the cover 40 is to be removed at some future time from a bumper 24, it is readily returned to its flat condition so that the user can readily store it in between seasons.

I claim:

1. For use with a boat hoist utilizing relatively fragile bumpers of foamed plastic, a protective cover comprising a tubular body formed from flexible sheet stock having a passage of uniform cross section extending completely therethrough of a size to accommodate therein a longitudinal portion of a foamed plastic bumper, both ends of said passage being open and of the same size and cross section as that of the tubular body forming said passage, and a pair of flaps integral with said tubular body and projecting from one of its said open ends, said flaps being composed of reversely folded tab sections of said sheet stock with their confronting surface portions secured together so that said flaps possess twice the thickness of the sheet stock constituting said tubular body.

2. A protective cover in accordance with claim 1 in which said sheet stock includes an elastomeric material.

3. A protective cover in accordance with claim 1 in which said sheet stock includes rubber.

4. A protective cover in accordance with claim 1 in which said sheet stock is laminated.

5. A protective cover in accordance with claim 1 in which the sheet stock forming said tubular body is composed of two sheets or plies of rubber and said flaps are composed of four sheets or plies of rubber.

6. A protective cover in accordance with claim 5 including a sheet of reinforcing fibers sandwiched between said sheets of rubber so that said flaps contain two sheets of reinforcing fibers, each being sandwiched between two sheets of rubber.

7. A protective cover in accordance with claim 6 in which said sheet of reinforcing fibers composed of crisscrossing filaments.

8. A protective cover in accordance with claim 1 in which said body has a pair of flaps at both ends.

* * * * *